United States Patent [19]

Andrews, Jr. et al.

[11] Patent Number: 4,629,270

[45] **Date of Patent: * Dec. 16, 1986**

[54] ZERO INSERTION FORCE CARD EDGE CONNECTOR WITH FLEXIBLE FILM CIRCUITRY

[75] Inventors: Howard W. Andrews, Jr., Hershey; Clifford F. Bobb, Carlisle, both of Pa.; Robert F. Cobaugh, deceased, late of Elizabethtown, Pa., by Jacqueline R. Cobaugh, executrix; Attalee S. Taylor, Palmyra, Pa.

[73] Assignee: AMP Incorporated, Harrisburg, Pa.

[ * ] Notice: The portion of the term of this patent subsequent to Dec. 2, 2003 has been disclaimed.

[21] Appl. No.: 658,943

[22] Filed: Oct. 9, 1984

Related U.S. Application Data

[63] Continuation-in-part of Ser. No. 630,923, Jul. 16, 1984, abandoned.

[51] Int. Cl.[4] ..... H01R 9/09

[52] U.S. Cl. ..... 339/75 MP; 339/176 MP

[58] Field of Search ..... 339/176 MP, 170 MF, 339/75 MP

[56] References Cited

U.S. PATENT DOCUMENTS

| | | | |
|---|---|---|---|
| 3,526,869 | 9/1970 | Conrad et al. | 339/75 MP |
| 3,609,463 | 9/1971 | Laboue | 339/17 LM |
| 4,080,027 | 3/1978 | Benasutti | 339/176 MP |
| 4,560,221 | 12/1985 | Olsson | 339/75 MP |

*Primary Examiner*—John McQuade

*Attorney, Agent, or Firm*—Allan B. Osborne

[57] ABSTRACT

The present invention relates to zero insertion force card edge connectors with flexible film circuitry interconnecting the mother printed circuit board on which the connector is mounted and the daughter printed circuit card received in the connector. Actuation of cam means closes the connector and moves the circuit pads on the film up and down against the card circuit pads to provide wipe and back-wipe.

83 Claims, 18 Drawing Figures

ZERO INSERTION FORCE CARD EDGE CONNECTOR WITH FLEXIBLE FILM CIRCUITRY

This Application is a continuation-in-part of Application Ser. No. 630,923 filed on July 16, 1984, now abandoned.

The use of flexible film i.e., printed circuitry on thin insulating material such as polyester film, to interconnect daughter cards to mother boards provides a means to achieve extremely high density interconnections. Further, flexible film circuitry provides impedance matching and thus transmission line characteristics. Connectors using such film are known from several patents dating back to the early 1960's. U.S. Pat. No. 3,102,767 is one such disclosure. Subsequently issued patents include U.S. Pat. No. 3,609,463 wherein a spring biased push member is utilized to urge the contacts on a flexible material against an inserted card. In this and other disclosures, e.g., U.S. Pat. No. 3,401,369, the card is inserted against the biased film, i.e, an insertion force is required. During insertion, the circuit pads on the film and card rub or wipe against each other to clean away debris and the like. However, such frictional wiping is difficult to control and damage to the circuit pads may occur, particularly in repeated insertion applications.

Zero insertion force card edge connectors are known from U.S. Pat. Nos. 3,614,707 and 3,922,054. Cards are inserted without force by spreading apart the side walls defining the slot. Spring members, being either separate components or forming an integral part of the connector, e.g., as shown in U.S. Pat. No. 3,922,054, provide a biasing force to urge the film against the card when the connector is closed. The zero insertion force connectors disclosed were not intended to and do not provide wiping between the circuit pads on the film and card.

Workers in the field are now conceptualizing and experimenting with zero insertion force flexible film connectors having wipe. However, there are difficulties associated with this advancement in the art, e.g., noted above as with frictional wipe, flexible film is readily susceptible to damage with respect to the circuits printed thereon. Further, alignment problems which are present in conventional card edge connectors having relatively large spaces between discrete metal contact elements are even more of a problem in flexible film connectors where the circuits are on extremely close spacing.

It is now intended to provide a card edge connector of the type described in the immediately preceding paragraph which solves the aforementioned problems as well as others.

A connector is disclosed for electrically connecting a circuit card to a circuit board through circuits on a flexible film with some circuits thereon being terminated to the board and at least one free side extending away thereform, comprising a base member for mounting on the board with a card receiving space therealongside, actuator means with cams thereon slidably mounted for longitudinal travel on the base member, a module having one surface for receiving a free side of a flexible film and further one or more cam followers, said module being mounted so that the one surface faces the card receiving space and the one or more cam followers cooperate with the cams so that by moving the actuator means longitudinally, the module moves laterally towards and away from the card receiving space and further perpendicularly relative to the base member.

For an understanding of the invention, reference will now be made by way of example to the accompanying drawings in which.

Figure 1:
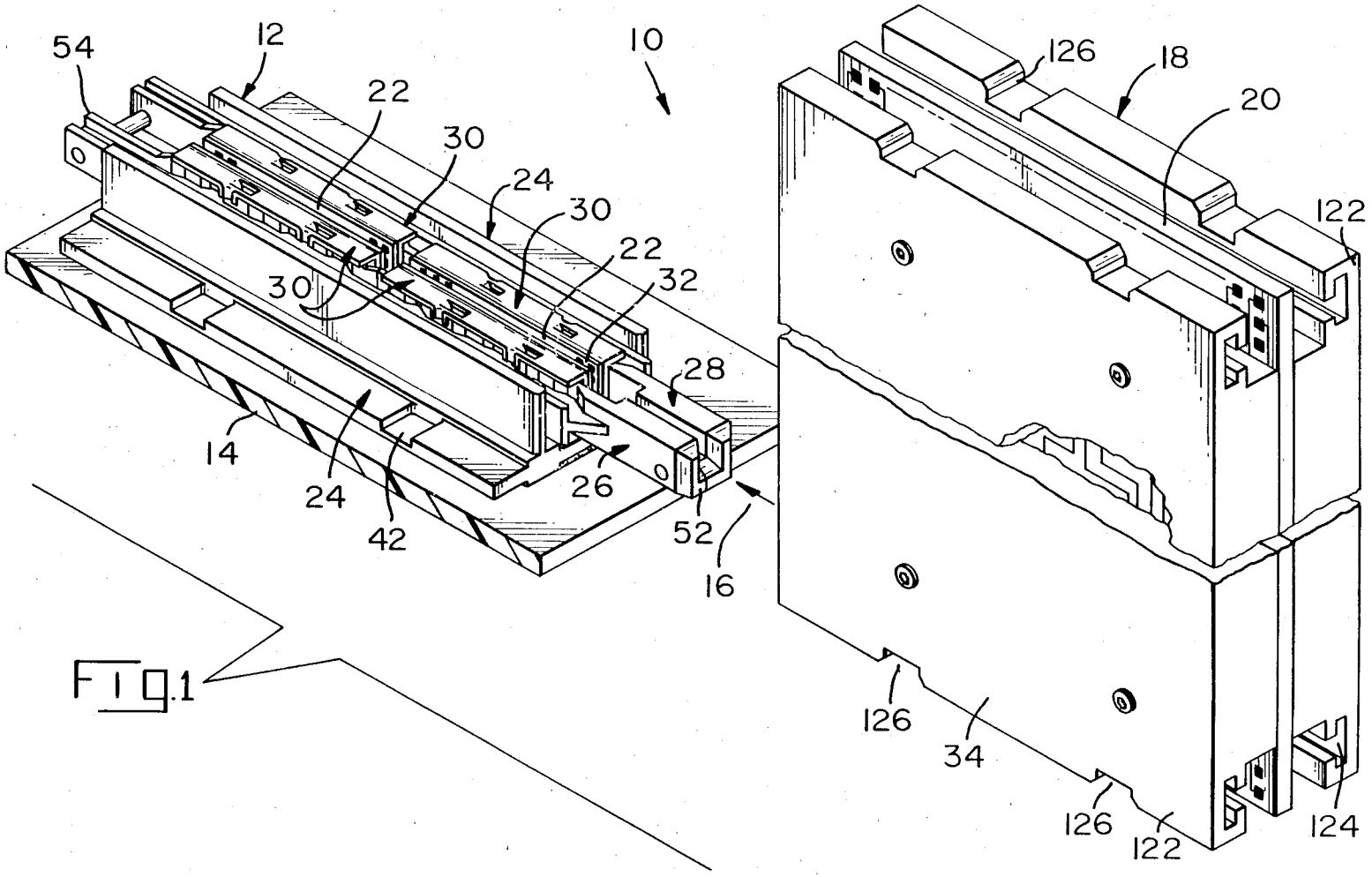
FIG. 1 is an isometric view of the first and second units which form the zero insertion force card edge connector of the present invention.
Figures 3A, 3B:
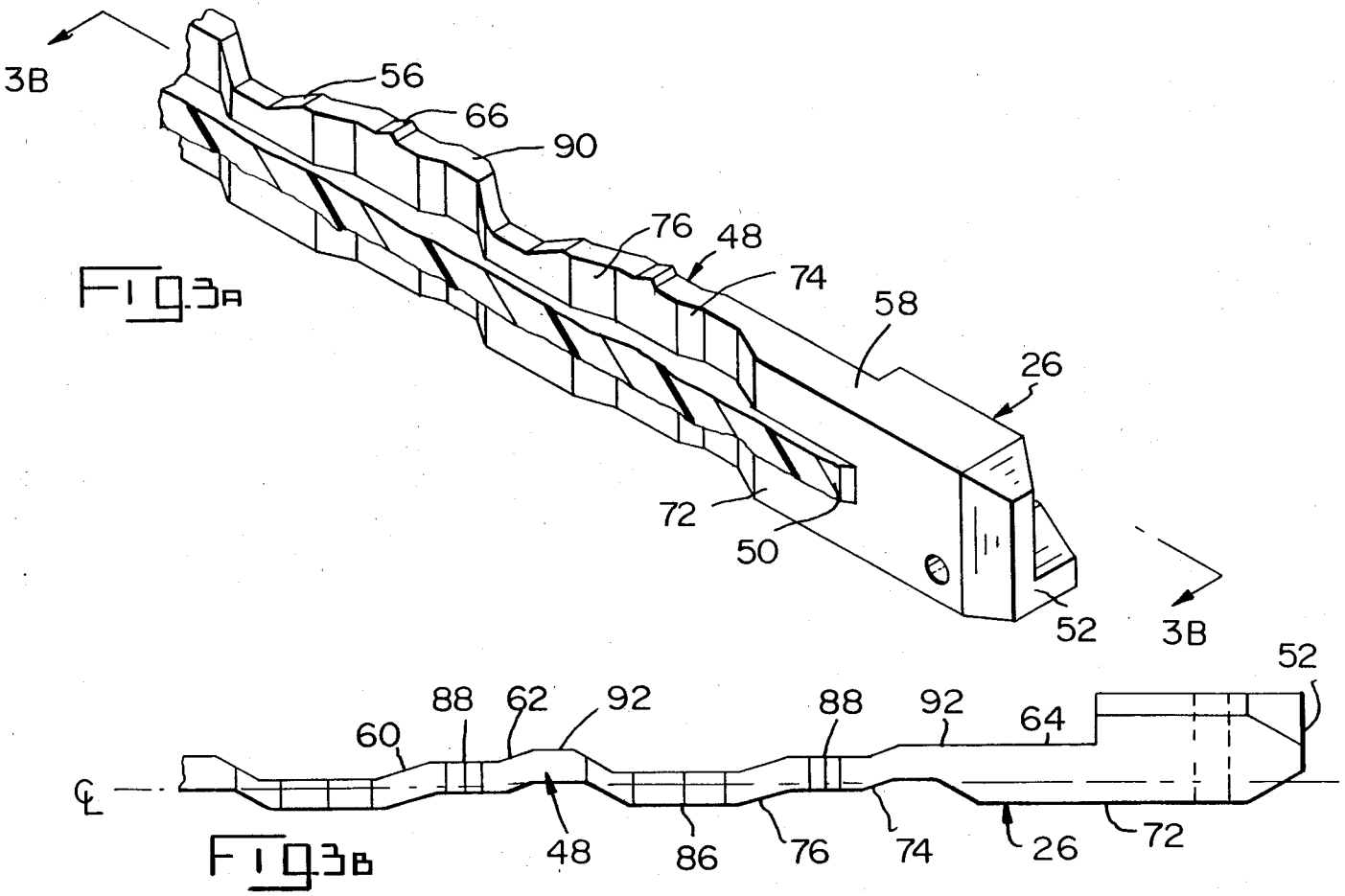
Figure 3C:
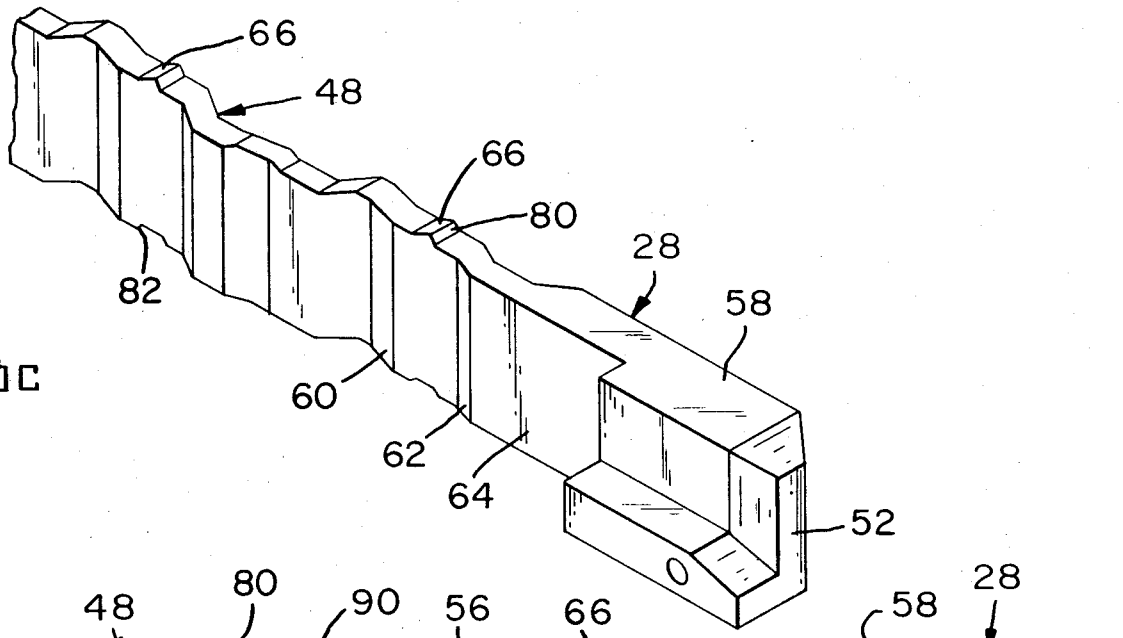
Figure 3D:
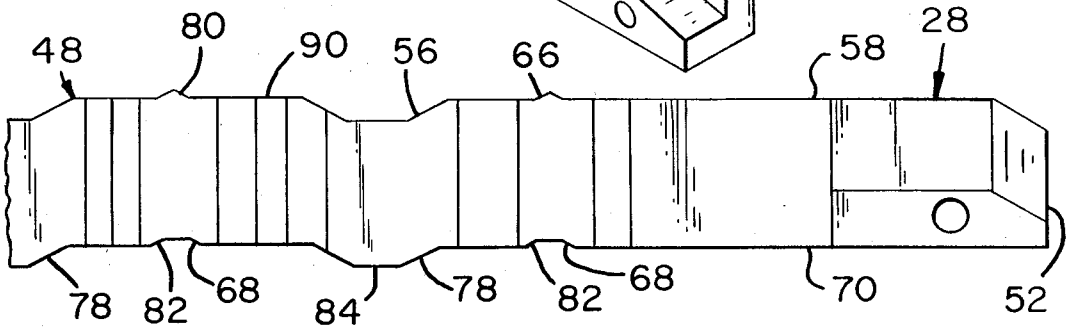
Figure 4:
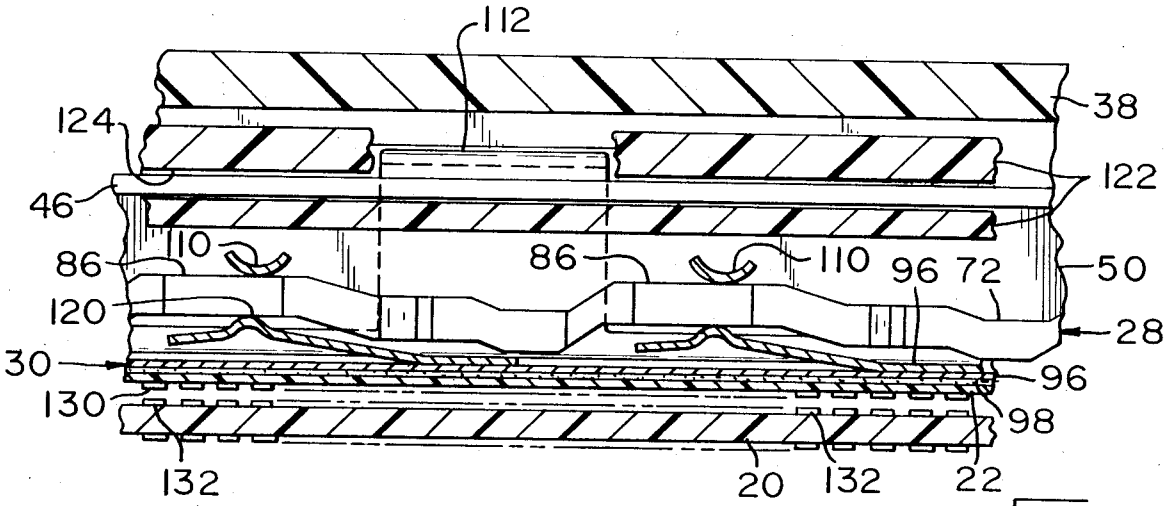
Figure 5:
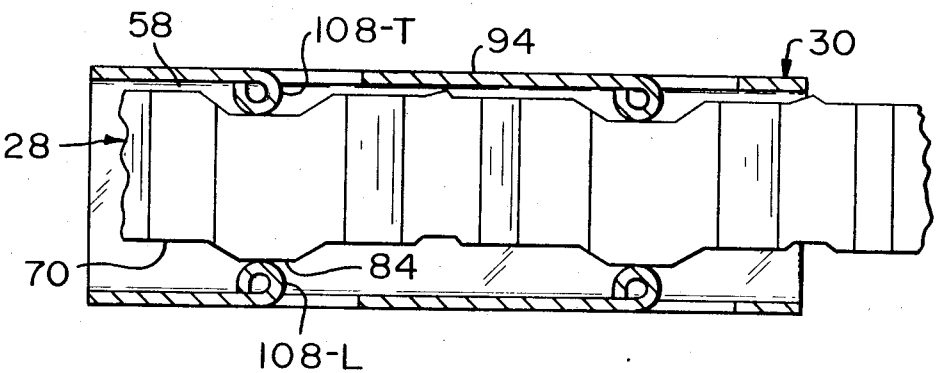
Figure 6A:
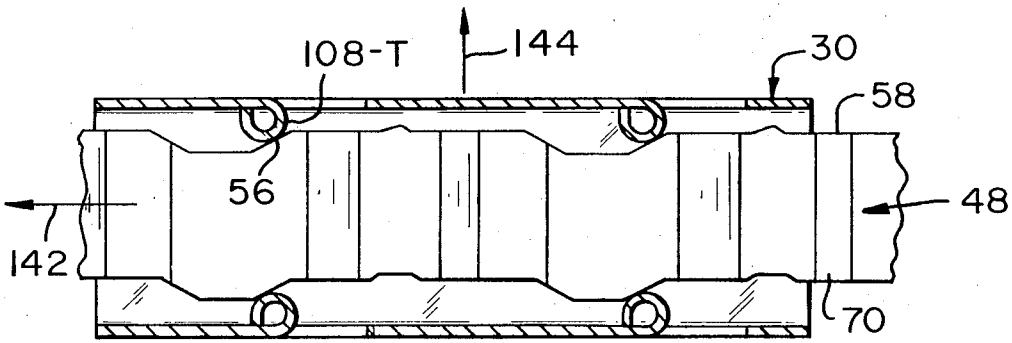
Figure 6B:
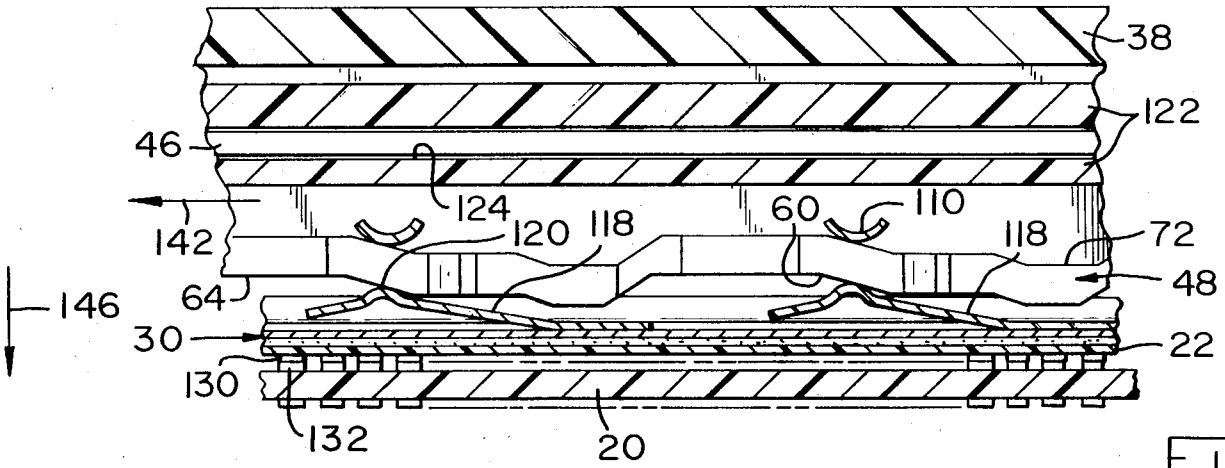
Figure 6C:
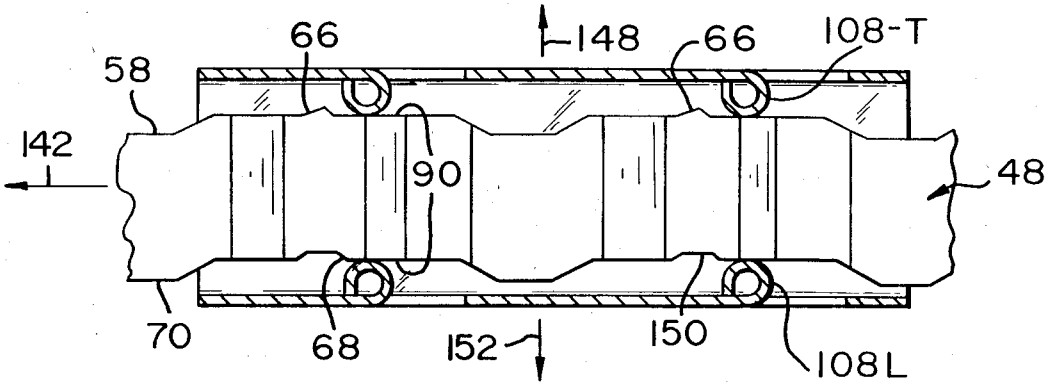
Figure 6D:
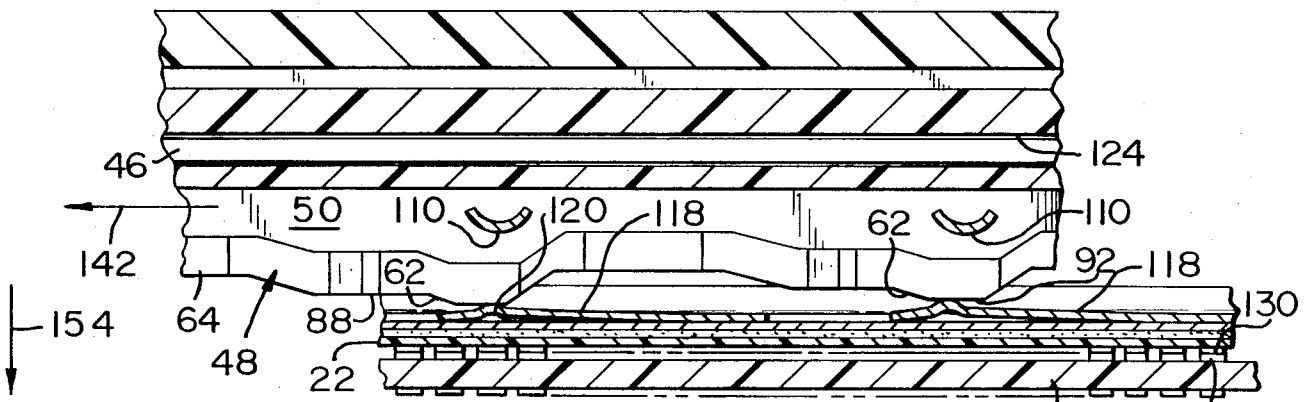
Figure 6E:
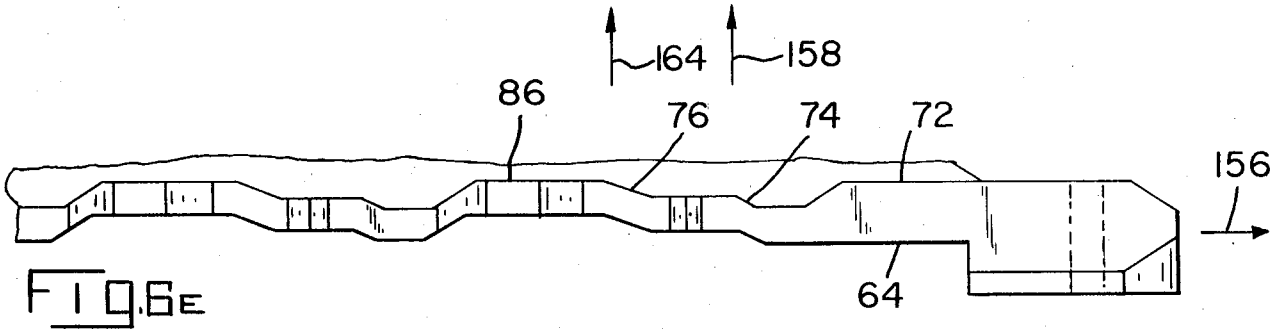
Figure 6F:
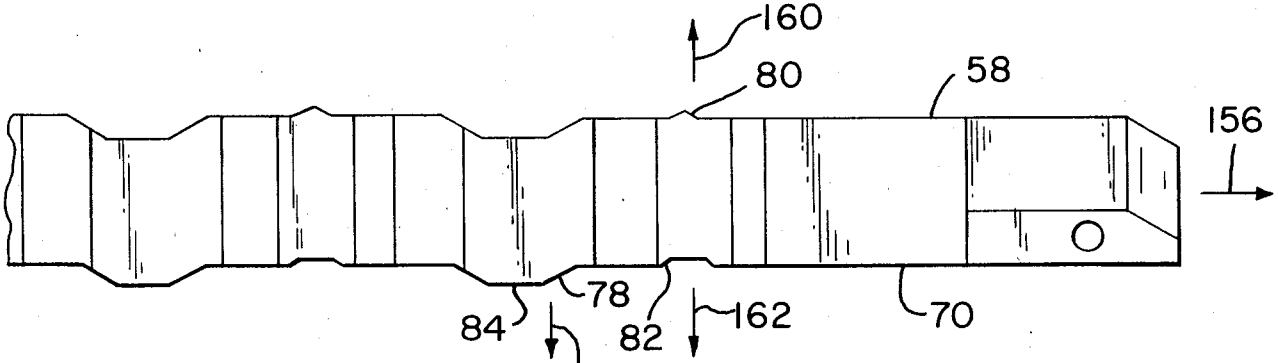
Figure 7:
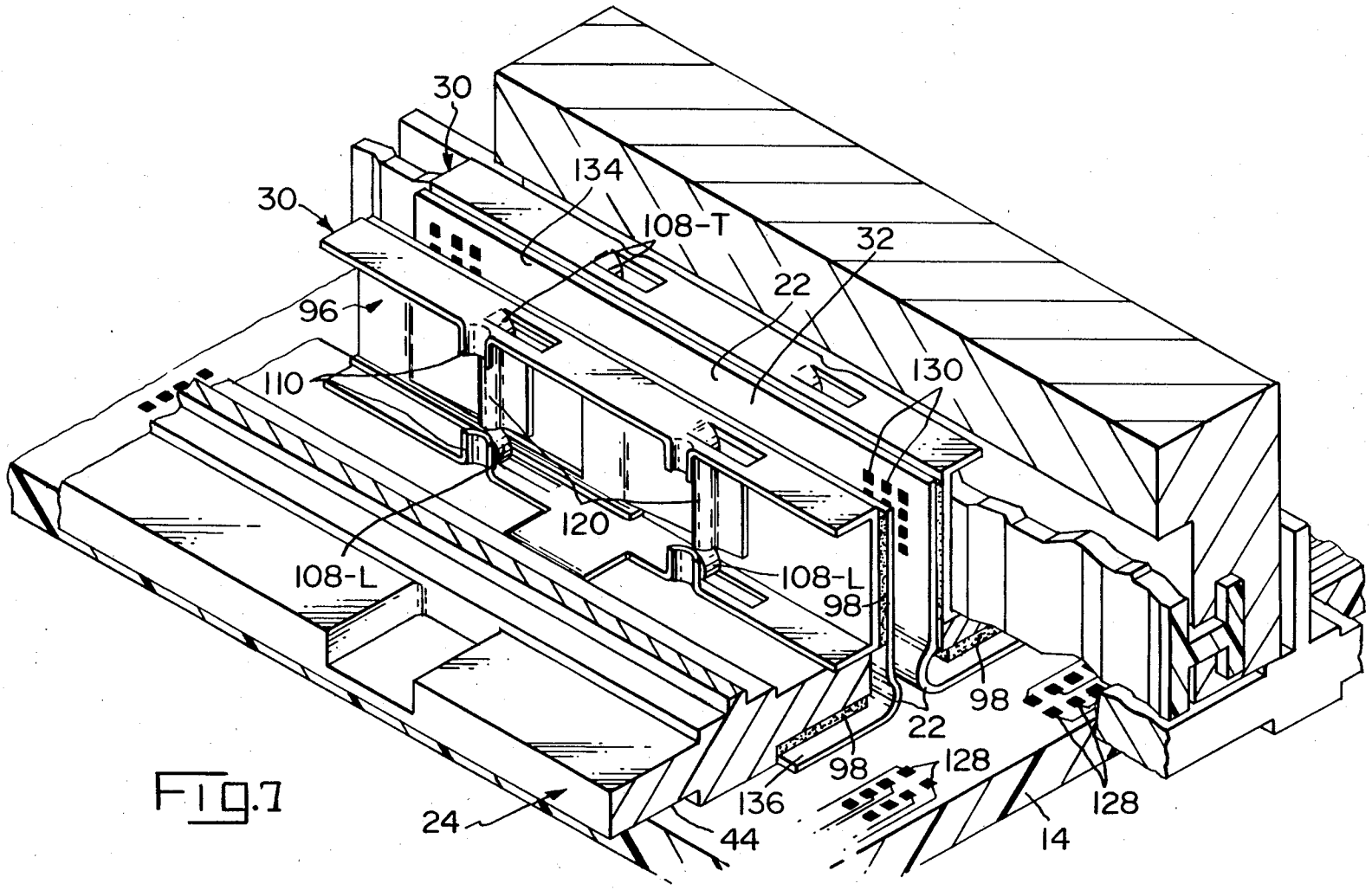
Figure 8:
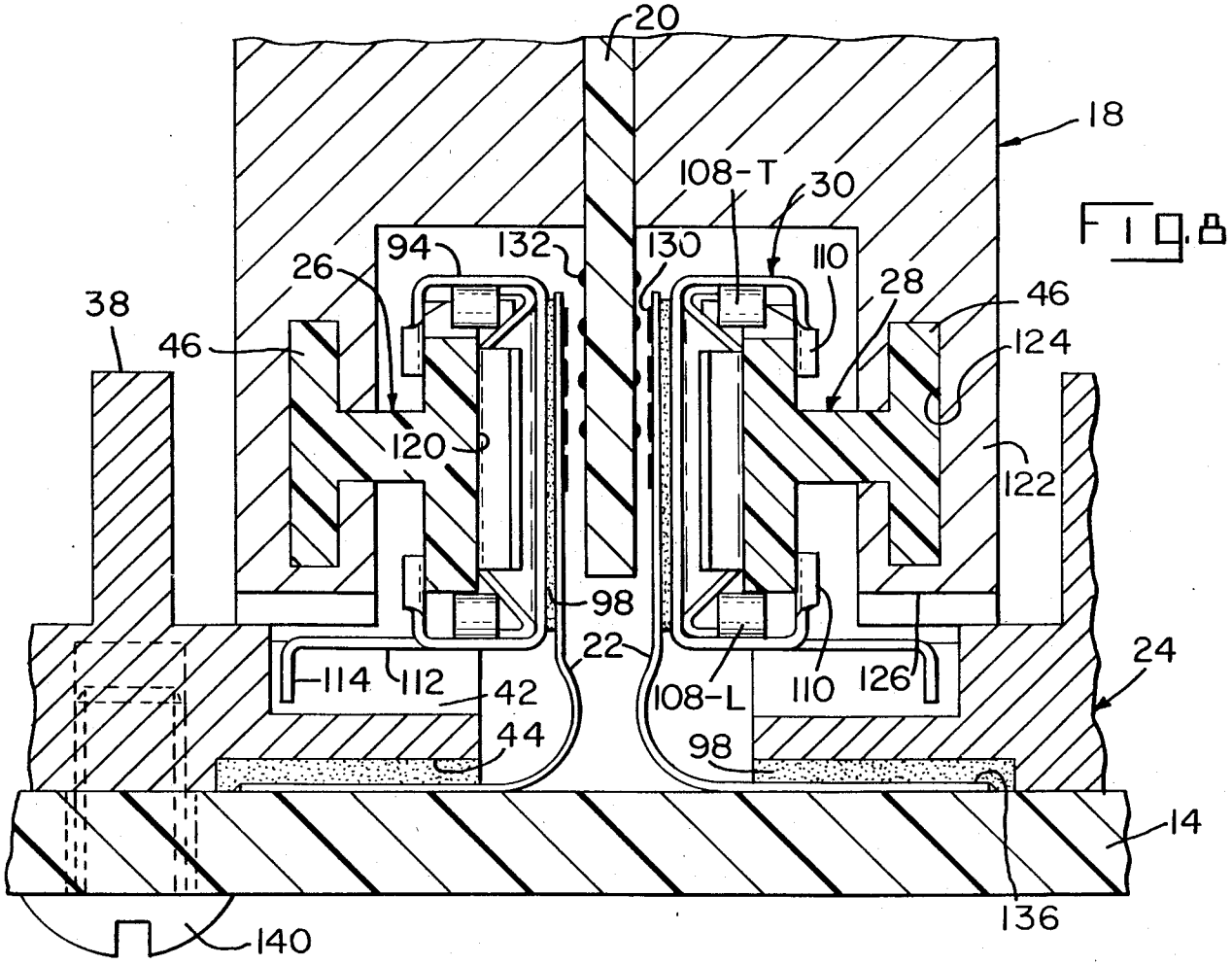
Figure 9:
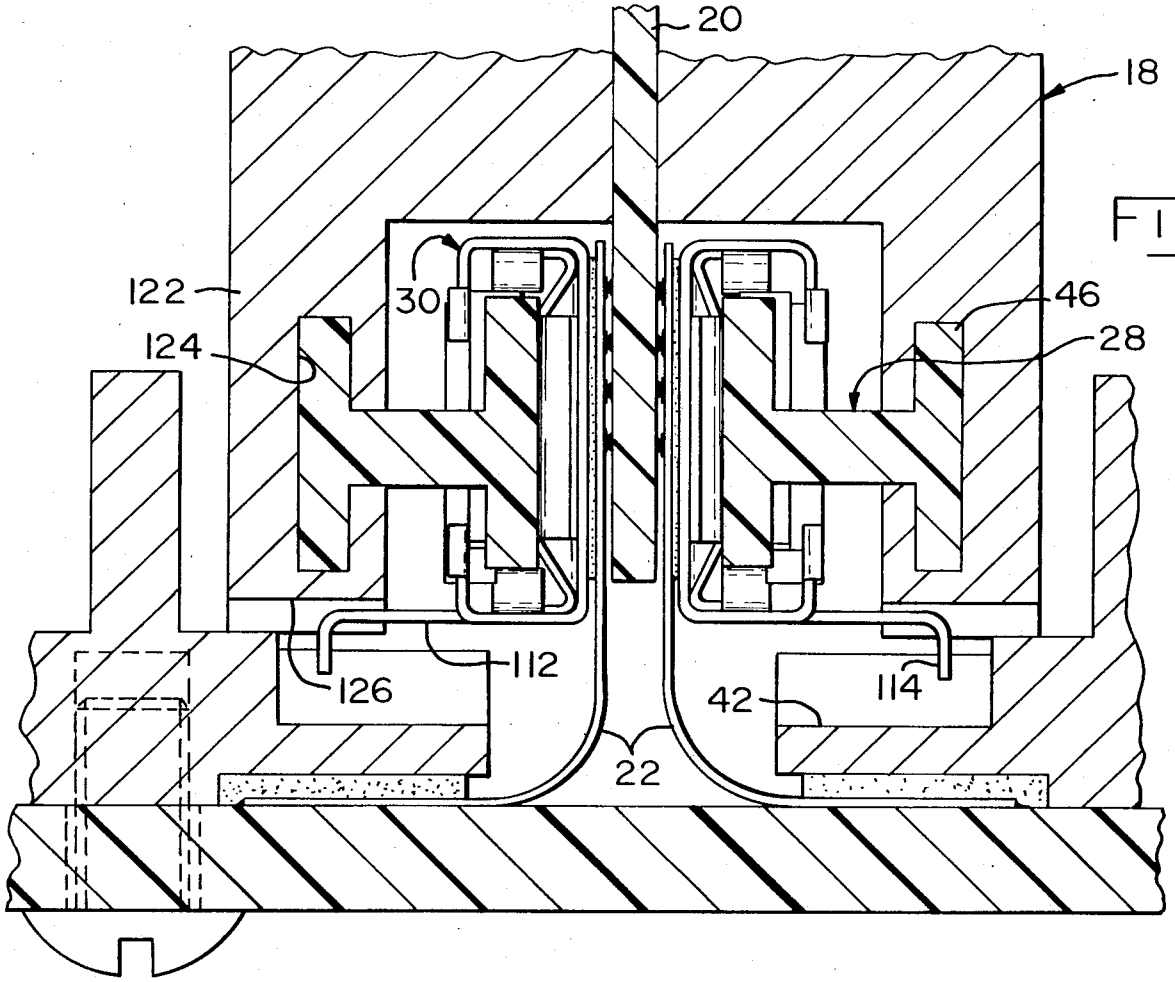

FIGS. 3-A through 3-D depict the cams on the actuators of the connector of FIG. 1;

FIGS. 4 and 5 are segmented and partially sectioned views showing the relationship between the cams and cam followers of the connector of the present invention;

FIGS. 6-A through 6-F illustrate the positioning of the cams and cam followers in the several steps of closing and opening the connector of FIG. 1;

FIG. 7 is a view of the connector of FIG. 1, partly sectioned and in various stages of assembly;

FIGS. 8 and 9 are cross-sectioned end views showing the connector of the present invention open and closed respectively.

Figure 10:
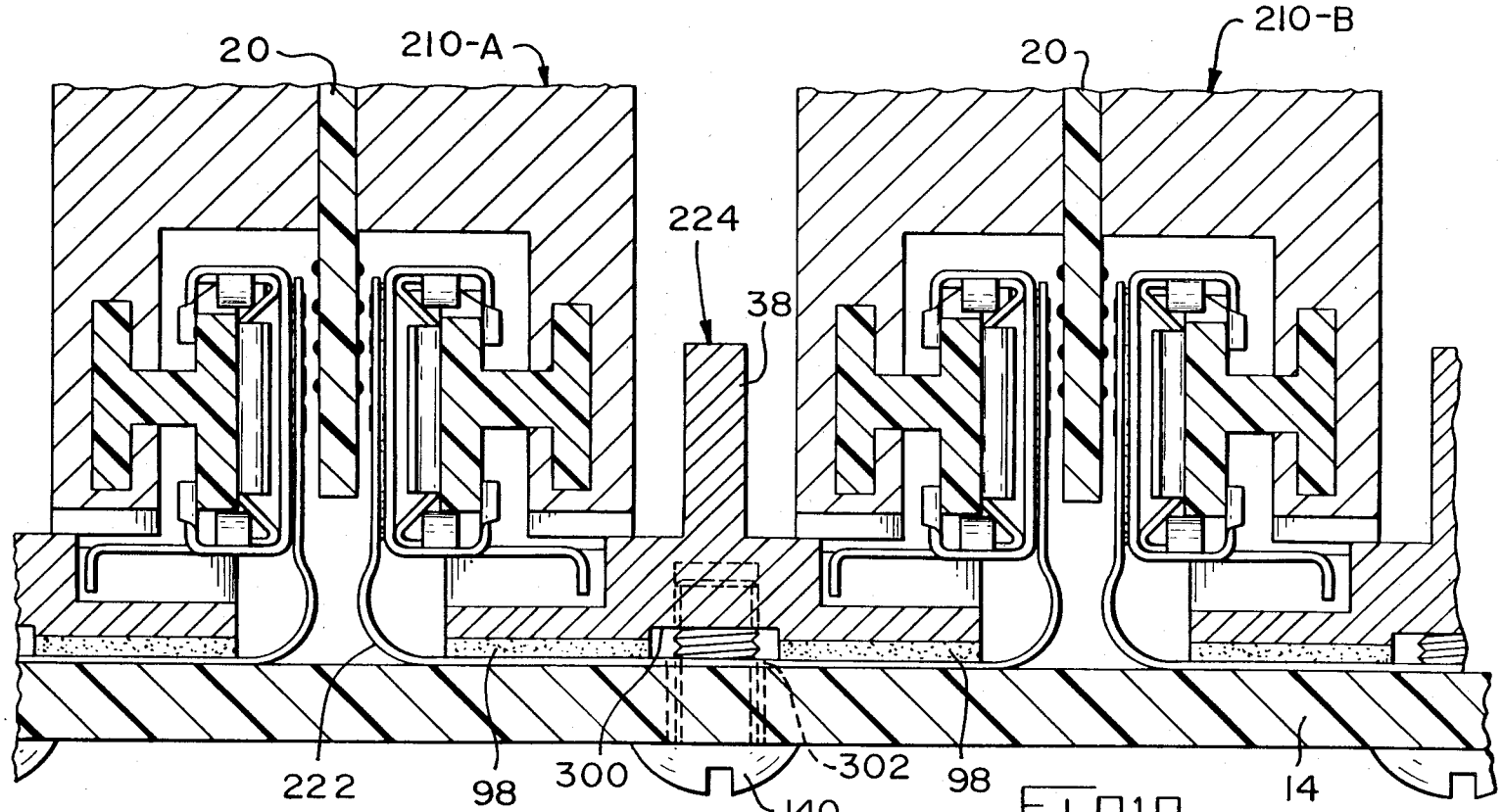

FIG. 10 is a cross-sectioned end view illustrating and embodiment wherein a strip of flexible film extends between adjacent connectors.

The ZIF (zero insertion force) card edge connector 10 of the present invention is shown in FIG. 1 with the first unit 12 on the left mounted on a back panel or mother board 14. The second unit 18, also referred to as a shroud assembly, carries daughter card 20 and is slid onto the first unit.

The connector which is described herein functions to interconnect circuits on both sides of card 20 to circuits on board 14 through circuits on flexible film strips 22. As will become apparent from the following description, the units may be modified to provide a connector which interconnects circuits on only one side of the card to the board.

The components of first unit 12 include a pair of spaced apart, parallel base members 24, left and right linear actuators 26 and 28 respectively and four modules 30, two being on each side of a card-receiving slot 32 defined by the positioning of the base members on the board.

The components of the second unit or shroud include a pair of actuator guide and card support members 34.

Figure 2:
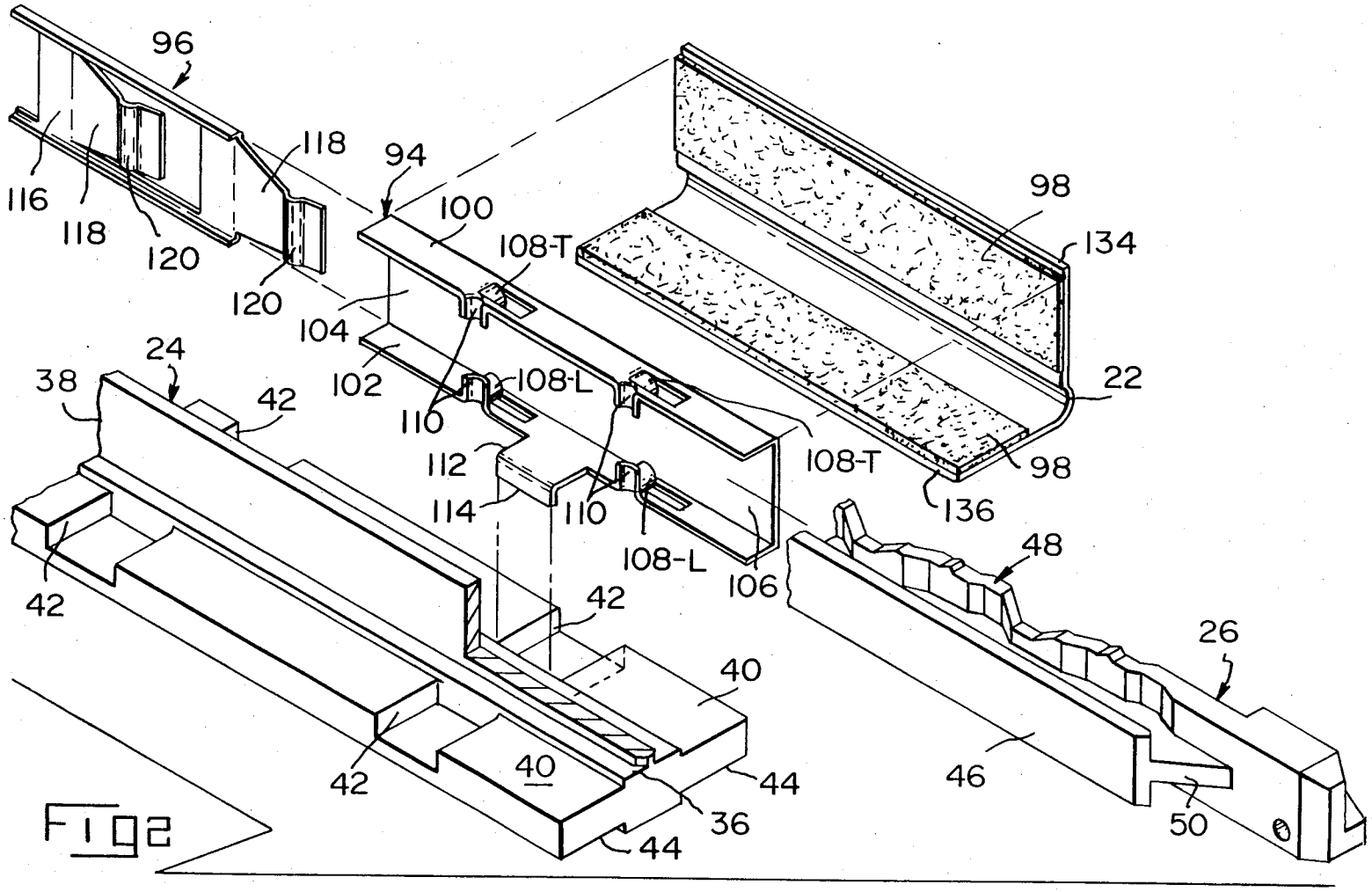
FIG. 2 is an exploded view of one-half of the first unit of FIG. 1.

With reference to FIG. 2, base member 24 includes a central platform 36 supporting an upright central partition 38. The platform and partition, extending longitudinally along the length of the base member, defines left and right sections 40. Notches 42 are provided in both sections. The undersurface of the base member is recessed along both edges as indicated by reference numeral 44.

The linear actuators 26, 28 of FIG. 1 are mirror images of each other and are not interchangeable in the illustrated embodiment. As shown in FIG. 2, each actuator 26, 28 has a general H-beam shape defined by a guide bar 46, cam bar 48, and connecting spacer 50 therebetween.

Each cam bar 48 in the illustrated connector of FIG. 1 carries four sets of cams located in tandem between front end 52 and back end 54. As will be appreciated by those skilled in the art, a connector of the present invention can be made to include cam bars having any number of cam sets.

For clarity, cam bars 48 in FIGS. 3-A through 3-D show only two sets of cams. As these and other Figures illustrate, the cams are a series of jogs along both top and bottom edges and on both sides or lateral surfaces. A center line $C_L$ in FIG. 3-B demonstrates clearly the lateral jogs. The vertical jogs along the edges are readily apparent from the drawing in FIG. 3-D. Note that the opposite-facing lateral sides track each other and the two opposite-facing edges track each other.

Each cam bar 48 has edge cams for moving modules 30 vertically and side cams for moving them laterally. The modules move up and in to close the connector and down and out to open the connector. In addition, intermediate vertical travel provides a wiping and back-wiping between film strips 22 and card 20. Some sections on cam bar 48 passively present either vertical or lateral travel.

With general reference to FIGS. 3-A through 3-D, the closing cams include cam 56 on top edge 58 (FIGS. 3-A and 3-D), and first and second pressure cams 60 and 62 respectively on the inside lateral surface 64 of the bar (FIGS. 3-B and 3-C).

The intermediate wipe and back-wipe cams include cam 66 on top edge 58 and cam 68 on bottom edge 70 (FIGS. 3-C and 3-D) respectively.

In opening the connector, the actuator travel is reversed with opening cams, located on outside lateral surface 72, including cams 74 and 76 (FIGS. 3-A and 3-B) and an unlocking cam 78 on bottom edge 70 (FIG. 3-D).

The aforementioned intermediate wiping action is reversely repeated during opening through cam 80 on top edge 58 and cam 82 on bottom edge 70 (FIGS. 3-C and 3-D).

Static "open" sections on cam bar 48 includes section 84 on the bottom edge 70 (FIG. 3-D) and section 86 on the outside lateral surface 72 (FIG. 3-B).

A static section is indicated by reference numeral 88 on inside lateral surface 64 (FIG. 3-B).

Static "closed" sections are section 90 on top edge 58 and section 92 on inside lateral surface 64 (FIGS. 3-A, 3-B and 3-D).

Other sections on the cam bar are not referenced as their purpose is simply to provide space for non-acting cam followers.

Both right and left actuators 26, 28 are fastened at the front and back ends together by dowels (not shown) or other fastening means. In the illustrated embodiment, the front ends may be secured together at the time of manufacturing; the back ends, however, must remain unconnected until after the actuators have been added to the first unit 12.

The components of module 30 are shown exploded out in FIG. 2 and are channel member 94, spring member 96, and a resilient pressure cushion 98. FIG. 7 shows an assembled module clearly.

Channel member 94 includes top side wall 100, lower side wall 102, and base wall 104. The three walls define channel 106 which is open at each end. Edge cam followers 108 are strips cut and rolled in from side walls 100, 102 with a convex surface facing into channel 106. The two spaced apart followers 108 on top side wall 100 are further indicated by the letter "T" being added to the reference numeral 108. Similarly, the followers on lower side wall 102 have the letter "L" appended to reference numeral 108. Arcuate-shaped return cam followers 110 are formed from ears on the edges of the side walls which are bent to extend over channel 106 with the convex surfaces facing base wall 104. There are four return cam followers 110 with each one being adjacent to an edge cam follower 108. As will be apparent, edge cam followers 108 cooperate with the cams on the edges of cam bar 48 to move module 30 vertically as shown in FIG. 5.

An L-shaped locating-locking finger 112 is attached to and extends out from lower side wall 102 with lip 114 thereof turned out ninety degrees.

Spring member 96 includes a plate 116 having a pair of resilient cantilever beams 118 obliquely extending therefrom. The convex surfaces adjacent the free ends of beams 118 are pressure cam followers 120. Cam followers 110 provide one set of lateral cam followers and cam followers 120 provide a second set. These cam follower sets cooperate with the cams on the lateral surfaces on cam bar 48 to move module 30 laterally as shown in FIG. 4.

With specific reference to FIG. 7, spring member 96 is positioned in channel 106 with beams 118 extending obliquely out towards the channel mouth. Each pressure cam follower 120 is in alignment with a pair of edge cam followers 108-T, 108-L and return cam followers 110. Cushion 98 is secured to the face of base wall 104 opposite the channel.

The shroud assembly 18 shown in FIG. 1 is for use in a card cage (not shown) wherein two first units 12 are mounted on two opposing boards and daughter card 20 extends between and is received in each unit. Two identical members 34, having a skirt 122 on the upper and lower surfaces, are fastened together with card 20 in between to form the assembly. Each member 34 is recessed to provide room for electronic components mounted on the card. A T-shaped slot 124 is provided along the inside of each skirt 122, extending axially for the length thereof and opening out at each end face. Recesses 126 are located in and along the edge of each skirt 122. The recesses 126 correspond in number and spacing to notches 42 in base members 24.

A shroud assembly 18 for use with a unit 12 on one board would have skirts on a lower surface only. Otherwise it would be identical.

The width of members 34 and skirts 122 are such that a space is provided between the free edges of card 20 and the inside surfaces of the skirts.

It will become apparent that shroud assembly 18 may be modified or even omitted with minor changes to first unit 12; i.e., first unit 12 is basically connector 10. It will also become apparent, though, that shroud assembly 18 as illustrated provides a means for guiding actuators 26, 28, for accurately registering card 20 to film strips 22 and for reducing or eliminating independent shifting of card 20 under thermal stresses.

Board 14, card 20 and flexible film strips 22, are of the multi-layered type with the circuits therein being exposed in the form of dots or pads which raise above the surface. The pads on card 20 and film strips 22 are located adjacent the edges and free sides and are arranged in rows. It should be noted however that other structures exist and the term "circuits" particulalry as used in the claims appended hereto, is intended to be broadly construed to include such other structure as well as the aforementioned dots or pads. FIG. 7 shows four such rows on board 14 and film strips 22 with the individual pads being indicated by reference numerals 128 on the board and 130 on film strips 22. Each side of card 20 similarly has four rows of pads reference by numeral 132 (FIG. 8). Each flexible film strip 22 has a width equal to a pressure cushion 98. The board, card and film are not part of the present invention.

One method of assembly of connector 10 begins with assembling modules 30 as noted above. Cushions 98 are bonded to sides 134 and 136 (FIG. 2) of film strips 22. The cushions 98 on sides 134 are then bonded to the outer surface of channel base wall 104.

The next step would be placing the modules on board 14 with side 136 of each film strip 22 in registration with circuit pads 128 on board 14. In one method the abutting pads 128 and 130 would be permanently joined using solder or the like. In another method, film strips 22 would be held in place by base member 24 and the cushions on side 136, which would be received in recesses 44, bearing down on the sides (FIG. 7). In either case, in the next step, base members 24 are attached or mounted on board 14, for example, by bolts 140 extending up through board 14 and into threaded apertures as shown in FIG. 8. Other mounting means may be used.

With base members 24 secured to board 14, modules 30 are placed on sections 40 with the L-shaped fingers 112 positioned in notches 42. Here again, FIG. 7, and more particularly the left side of the now-defined card edge slot 32, shows this assembly step.

The final step with respect to the first unit is to add linear actuators 24, 26. The cam bars 48 are slid through modules 30 and between edge cam followers 108-T and 108-L (see FIG. 5) and bracketed by cam followers 110 and 120; i.e., more particularly, cam followers 120 are adjacent inside lateral surfaces 64 (see FIGS. 3-C and 4) and cam followers 110 are adjacent outside surfaces 56 (see FIGS. 3-A and 4). The guide bars 46 will be near central partitions 38 on base members 24. Back ends 54 may now be joined together as are front ends 52 if such had not been joined before.

In the embodiment illustrated and as shown in FIG. 1, each linear actuator 24, 26, with four sets of cams, is associated with two modules 30. As will be recalled, each module 30 has two sets of cam followers with each set consisting of one each of edge cam follower 108-T and 108-L, two return cam followers 110 and one pressure cam follower 120. The provision of each module 30 having two spaced apart sets of cam followers with each set being acted upon by a set of cams provides stability to modules 30 during the operation of connector 10.

The assembly of the second unit 18, i.e., the shroud assembly, has been described above.

The first unit 12 must be in an open position before sliding second unit 18 onto it. More particularly, film strips 22 must be withdrawn from interfering with card 20 entering card edge slot 32. The open position is obtained by locating the linear actuators 24, 26 so that cam followers 110 are against static open locations 86 on the outer side 72 of each cam bar 48 (FIG. 4, and with reference to FIG. 5, cam followers 108-L are on the static open locations 84 on bottom edge 70.

The second unit 18 or shroud assembly may now be freely slid axially into the first unit 12. The portion of card 20 between the skirts enters card edge slot 32, the skirts 122 move on central platforms 36 of base member 24 with guide bars 46 being received in T-shaped slots 124. The cam bars 48 and modules 30 are located between the skirts 122 and card 20. Appropriate stop means (not shown) provide the proper longitudinal positioning of the two units 12, 18. FIG. 7 shows the right-hand side of connector 10 as assembled. FIG. 8 is an end sectional view showing the assembly and relation between the several components with the connector in the open position. Note in that Figure that film strips 22 are spaced outwardly from card 20 and that circuit pads 120 on strips 22 are spaced or offset downwardly relative to circuit pads 132 on card 20. Further, note the positioning of locating-locking fingers 112 and lips 114 in notches 42.

The connector is closed and electrical contact established between the circuit pads 130, 132 on film strips 22 and card 20 by moving actuators 26, 28 longitudinally, which in the embodiment illustrated is toward the back of connector 10. The longitudinal travel moves modules 30 laterally and vertically. Generally, the sequence of what happens is that, first, modules 30 are moved vertically upwardly to register and lock first unit 12 to shroud assembly 18. Next, modules 30 are moved laterally to lightly press circuit pads 130 on film strips 22 against circuit pads 132 on card 20. The modules 30 are then moved up and down so that those circuit pads wipe against and clean each other of debris and the like. In the final step, modules 30 are moved laterally further into slot 32 to press circuit pads 130 against circuit pads 132 with a preferred normal force, e.g., about 80 grams per contact pad. The connector 10 is now in the closed position.

The exact step-by-step motions will now be described with reference to FIGS. 6-A through 6-D.

As will be recalled, th cam and cam followers are positioned with respect to each other as shown in FIGS. 4 and 5; i.e., connector 10 is in the open position. With reference to FIG. 6-A, upon moving linear actuators 26, 28 rearwardly as indicated by arrow 142, modules 30 move upwardly in the direction of arrow 144 by reason of edge cam followers 108-T riding up on cams 56 on top edge 58 on cam bars 48. Locating-locking fingers 112 are pulled up into recesses 126 in the edges of skirts 122 on shroud assembly 18 as shown in FIG. 9. With the lower portion of lips 114 on fingers 112 still being within the confines of notches 42 (see FIG. 9), shroud assembly 18, modules 30 and base members 24 are located and locked together to provide and maintain correct longitudinal registration between film strips 22 and card 20. Further, the vertical motion has raised circuit pads 130 into alignment with circuit pads 132 on the card.

Cam followers 110 and 120 are adjacent sections on the cam bars 48 which are parallel to the longitudinal axis and, accordingly, there is no lateral travel by modules 30 (as shown in FIG. 4).

Further actuator travel now results in modules 30 being moved laterally in to press circuit pads 130 on film strips 22 against circuit pads 132 on card 20. The cause for this motion is cam followers 120 being pushed against by cams 60 on the inside surfaces 64 of cam bars 48. FIGS. 6-B shows this with the lateral motion indicated by arrow 146. The normal force being exerted against pads 130, 132 is minimal at this point and the pre-load on the cantilever beams 118 would not be exceeded. Concurrently, the cam followers 108 are riding on horizontal sections preceding the wiping cams and, accordingly, there is no vertical travel by modules 30.

With light pressure being exerted on circuit pads 130, 132, the next action is to wipe them against each other. With reference to FIG. 6-C, wipe or more particularly up-wipe occurs by cam followers 108-T riding up cams 66 on top edge 58 of cam bars 48 to move the modules upwardly as indicated by arrow 148. Back-wipe occurs by cam followers 108-L, which have entered recesses 150 on the bottom edge 70, riding down cams 68, pulling the modules back down as indicated by arrow 152.

During the vertical motion, cam followers 120 are riding against longitudinally parallel static sections 88 and, accordingly, there is no lateral movement.

After wiping, the final step is to press circuit pads 130 on film strips 22 in more firmly against circuit pads 132 on card 20. FIG. 6-D illustrates the cam and cam follower relationship in this final action. Cam followers 120 are engaged by cams 62 on the inside surfaces 64 of cam bars 48. With actuators 26, 28 still moving in the direction of arrow 142, the modules 30 are forced further into card edge slot 32 to increase the pressure of circuit pads 130 on film strips 22 against circuit pads 132 on card 20. The lateral motion is indicated by arrow 154. This final loading provides the required normal force on circuit pads 130, 132 for effective electrical contact. The pressure pad 98 and cantilever beams 118 are almost or fully compressed. As the beams 118 approach the fully compressed condition, the free ends thereof abut base wall 104 and accordingly, the force to further compress the cam follower 120 increases. Thusly, there is a two stage spring; one where beam 118 is attached at only one end and the second where the free end becomes supported. If card 20 is warped or otherwise uneven, the unevenness will be compensated for by pressure pad 98 and cantilever beams 118 so that a constant normal force on circuit pads 130, 132 is maintained along the length of card 20 and film strips 22.

This last segment of longitudinal travel by actuators 26, 28 places cam followers 120 against the static closed sections 92 and connector 10 is closed. Note in FIG. 6-D that cam followers 110 are no longer following along the outside surface of cam bars 48 but are spaced away therefrom due to the compression of cantilever beams 118. Edge cam followers 108 are positioned on horizontal static closed sections 90 as shown in FIG. 6-C.

FIG. 9 is a cross-sectional end view of a closed connector 10 showing the positioning of the several components in relation to each other.

The connector 10 is opened by pulling actuators 26, 28 in the reverse direction. The modules 30 are driven through the same lateral and vertical motions as in the closing but in the opposite or reverse directions. With reference to FIGS. 6-E and 6-F, these reverse steps will be indicated by arrows. The direction of longitudinal travel by the actuators is indicated by arrow 156. The first action is modules 30 being pulled slightly away, arrow 158, FIG. 6-E, from card 20 by cam followers 110 being engaged by the cam 74 on outside lateral surfaces 72. The modules 30 are then moved up as indicated by arrow 160, FIG. 6-F, by cam followers 108-T being engaged by cam 80 on the top edge 58 and down, arrow 162, FIG. 6-F, by cam followers 108-L being engaged by cams 82 on bottom edge 70. There is no lateral travel during this reverse wiping step. Lateral travel as indicated by arrow 164 in FIG. 6-E occurs next as cam followers 110 are engaged by cams 76. Modules 30 are now pulled completely back from card 20. Finally, modules 30 are moved down, arrow 166, FIG. 6-F, to remove fingers 112 from recesses 126 in the shroud assembly 18 skirts. This is accomplished by cam followers 108-L being engaged by cam 78 on bottom edge 70 of the cam bars.

This final actuator movement opens the connector and places cam followers 110 against sections 86, FIGS. 6-E and 4, and cam followers 108-L against, sections 84 on bottom edge 70 as shown on FIG. 6-F and FIG. 5.

The shroud assembly 18 is now free to be removed from first unit 12 without damaging film strips 22 or circuits on card 20.

FIG. 10 illustrates a modified base member 224 with a flexible film strip 222 extending from a module 30 on one side of central partition 38 to a module 30 on the other side of partition 38. Accordingly, one continuous film strip 222 serves two adjacent, parallel daughter cards 20. The undersurface of the modified base member 224 has a center, longitudinally extending recess 300. Bolts 140, extending upwardly through board 14 are received in threaded apertures opening out of the floor of this recess 300. Film strips 222 include holes 302, indicated by dashed lines, through which bolts 140 pass. The film strip 222 is of sufficient length to extend across to base of base member 224 and to modules 30 positioned on each side of central partition 38. Circuits on film strip 222 (not shown) may be designed to terminate as does the circuit on a film strip 22 or may continue from card to card. Cushions 98 are provided as described above with respect to connector 10.

FIG. 10 also illustrates the sharing of one base member 224 by the other components in forming two adjacent connectors 10.

Base members 24, 223 and card support members 34 are preferably made from aluminum. The channel members 94 and spring members 96 are made of plated steel. Pads 98 and cushions 136 are preferably made from silicone. Actuators 26 and 28 are preferably made from a glass-filled Polybutyleneterephthlate sold by General Electric Company under the tradename of VALOX 420-v SEO.

The choice of the above noted materials provide, as known at this time, the least possible opportunity for separate component movement via differential thermal expansion and contraction.

Some suggested modifications have been already noted elsewhere. For example, base members 24 may be made having only a left or right-hand section 40 to form a single connector or to provide terminal sides to a plurality of connectors spanning a mother board. FIG. 2 illustrates, in this sense, a connector adapted to interconnect circuits on one side of a card only. Modifications require, in general, a confirming member on the right-hand side of the card, and a shroud consisting of the left-hand member and card with perhaps a support of some kind on the right-hand side to cooperate with the confining member.

Yet another modification relates to the L-shaped finger 112 on the modules and the method of registering the several units together. Other means and methods can be employed; i.e., first, cooperating means to register the base member and shroud together and second, cooperating means to register the shroud and modules together. It should be clear that registration between the base members and other units is the less critical than registration between the shroud and modules. Other modifications and embodiment will occur to those having ordinary skill in the art, both from the foregoing description and from the spirit and scope of the appended claims.

We claim:

1. A connector for electrically connecting the circuits on one side of a circuit card to circuits on a circuit board through circuits on a flexible film having some circuits thereon terminated to circuits on the board and further having at least one free side extending away from the board, comprising:

a. an elongated base member for mounting on a circuit board with a circuit card receiving space there alongside;

b. support means on the base member for supporting actuator means;

c. actuator means having cams thereon slidably mounted on the support means on the base member for longitudinal travel; and d. a module having one surface for receiving a free side of a flexible film and one or more cam followers, the module being movably mounted so that the one surface faces the card receiving space and the one or more cam followers cooperate with the cams such that by moving the actuator means longitudinally, the module moves laterally towards and away from the card receiving space.

2. The connector of claim 1 wherein the module includes cam followers which cooperate with cams on the actuator means to move the module perpendicular relative to the base member during longitudinal travel of the actuating means.

3. The connector of claim 2 wherein the lateral and perpendicular movements of the module are time separated.

4. The connector of claim 2 further including cooperating locating means for positioning the base member, support means and module in a predetermined registration, one with the other.

5. The connector of claim 4 wherein said locating means further provide means for removably locking the module against longitudinal travel.

6. The connector of claim 2 wherein the support means include card support means for supporting a card extending into the card receiving space alongside the base member.

7. The connector of claim 6 wherein the support means includes a skirt having a slot extending along the length thereof and opening out towards the card receiving space and further the actuator means includes a guide bar slidingly received in and supported by the slot.

8. The connector of claim 7 wherein the cams on the actuator means are carried on a cam bar which is joined to the guide bar by connecting means such that the cam bar is positioned between the skirt and the card receiving space.

9. The connector of claim 8 wherein the cams are positioned on the sides and edges of the cam bar.

10. The connector of claim 9 wherein the module is positioned on the cam bar.

11. The connector of claim 9 wherein the module includes opposing side walls and a base wall extending therebetween to define a channel through which the cam bar slides.

12. The connector of claim 11 wherein cam followers are provided on the opposing side walls to cooperate with the edge cams on the cam bar to move the module perpendicular relative to the base member.

13. The connector of claim 12 further providing a set of cam followers adjacent the base wall of the module to cooperate with cams on one side of the cam bar to move the module laterally towards the card receiving space.

14. The connector of claim 13 further providing another set of cam followers extending over the mouth of the channel of the module to cooperate with cams on another side of the cam bar to move the module laterally away from the card receiving space.

15. The connector of claim 14 wherein the cam followers on the side walls and the cam followers extending over the channel mouth are integral with and formed from the same material as the side walls.

16. The connector of claim 14 wherein the set of cam followers adjacent the base wall includes one or more obliquely extending cantilever beams with a convex surface adapted to bear against the cams on one side of the cam bar, said convex surface being provided near the free end of the beam.

17. The connector of claim 16 wherein the one or more cantilever beams are formed from and are a part of a plate positionable adjacent the base wall of the module.

18. The connector of claim 16 wherein the module is positioned on the cam bar such that the sides of the cam bar are in betwen the cam followers on the cantilever beams and the cam followers extending over the channel mouth.

19. The connector of claim 18 wherein the cam followers extending over the channel mouth are attached to the free edges of the opposing side walls.

20. The connector of claim 19 wherein the cam engaging surfaces on the cam followers are convex.

21. The connector of claim 20 wherein the flexible film receiving surface on the module includes a resilient cushion.

22. The connector of claim 18 wherein the module includes two spaced apart cam followers extending over the channel mouth from each side wall, said cam followers being arranged to provide two equal sets of the three varieties with the cam followers in each set being in close proximity with each other.

23. The connector of claim 22 wherein a cam bar includes a plurality of sets of cams with each adjacent two sets cooperating with the two sets of cam followers on the module.

24. The connector of claim 23 further including cooperating locating means on the skirt and on the module for locating actuating means and module in proper registration with each other.

25. The connector of claim 24 wherein the cams and cam followers cooperate to move the module in the following, time separated, sequential movements as the cam bar moves longitudinally in one direction:

a. in towards the card receiving space;

b. perpendicularly away from the base member;

c. perpendicularly towards the base member; and d. further in towards the card receiving space.

26. The connector of claim 17 wherein the cantilever beam provides a two-stage spring, a first stage being during the compression thereof as a cantilever beam and the second stage being during compression thereof with the free end abutting the plate.

27. A connector for electrically connecting a circuit card to a circuit board through circuits on flexible film strips with some circuits on the strips being terminated to the board and with at least one free side of each strip extending away from the board, comprising:

a. a pair of elongated base members adapted for mounting on a circuit board in spaced apart, parallel fashion to define a card slot there between into which a circuit card may be placed;

b. actuator guide means located on each base member and adapted to slidingly receive actuator means;

c. actuator means having cams thereon and slidably located in the actuator guide means for longitudinal travel;

d. at least two modules having cam followers and a receiving surface for receiving a free side of a flexible film strip, said modules being positioned on each side of the card slot with the receiving surface facing thereinto and with the cam followers cooperating with the cams on the actuator means so that by moving the actuator means longitudinally, the modules move laterally towards and away from the card slot.

28. The connector of claim 27 wherein the modules include cam followers which cooperate with cams on the actuator means to move the modules perpendicular relative to the card slot.

29. The connector of claim 27 further including cooperating locating means on and for positioning the base members, actuator guide means and modules in a predetermined registration, one with the other.

30. The connector or claim 29 wherein said locating means further provide means for removably locking the modules against longitudinal travel.

31. The connector of claim 29 wherein the actuator guide means may be fastened together with a circuit card there between so that upon locating the actuator guide means on the base members, the card extends into the card slot.

32. The connector of claim 31 wherein the actuator guide means include skirts having guide bar support means extending along the lengths thereof and wherein the actuator means includes a guide bar which is slidingly received in and supported by the guide bar support means.

33. The connector of claim 32 wherein the cams on the actuator means are carried on a cam bar which is joined to the guide bar by connecting means such that the cam bar is positioned between the skirt and the card slot.

34. The connector of claim 33 wherein the cams are positioned on the sides and edges of the cam bar.

35. The connector of claim 34 wherein the modules are adapted to be positioned on the cam bars and with the cam followers cooperating with the cams.

36. The connector of claim 34 wherein the modules include opposing side walls and a base wall extending there between to define a channel through which the cam bar slides.

37. The connector of claim 36 wherein cam followers are provided on the opposing side walls to cooperate with the edge cams on the cam bar to move the modules perpendicular relative to the base members.

38. The connector of claim 37 further providing a set of cam followers adjacent the base wall of the modules to cooperate with cams on one side of the cam bar to move the modules laterally towards the card slot.

39. The connector of claim 38 further providing another set of cam followers extending over the mouth of the channel to cooperate with cams on another side of the cam bar to move the modules laterally away from the card slot.

40. The connector of claim 39 wherein the cam followers on the side walls of the modules and the cam followers extending over the channel mouth of the modules are integral with and formed from the same materials as the side walls.

41. The connector of claim 39 wherein the set of cam followers adjacent the base wall of the modules include one or more obliquely extending cantilever beams with a convex surface adjacent the free ends adapted to bear against the cams on one side of the cam bar.

42. The connector of claim 41 wherein the one or more cantilever beams are formed from and are a part of a plate positionable adjacent the base wall of the modules.

43. The connector of claim 42 wherein the modules are positioned on the cam bars such that the sides thereof are in between the cam followers on the cantilever beams and the cam followers extending over the channel mouth.

44. The connector of claim 43 wherein the cam followers extending over the channel mouth are attached to the free edges of the opposing side walls.

45. The connector of claim 44 wherein the cam engaging surfaces on the cam followers are convex.

46. The connector of claim 45 wherein the flexible film receiving surface on the modules include resilient cushion.

47. The connector of claim 43 wherein each module includes two spaced apart cam followers on each side wall, two cantilever beam cam followers and two cam followers extending over the channel mouth from each side wall, said cam followers being arranged to provide two equal sets of the three varieties with the cam followers in each set being in close proximity with each other.

48. The connector of claim 47 wherein each cam bar includes a plurality of sets of cams with each adjacent two sets cooperating with the two sets of cam followers on each module.

49. The connector of claim 48 further including locating means on each skirt and an on each module which cooperate to locate the actuating guide means and modules in proper registration with each other.

50. The connector of claim 49 wherein the cams and cam followers cooperate to move the modules in the following, time separated, sequential movements as the cam bars move longitudinally in one direction.

a. perpendicularly to locate the actuating guide means and modules in registration with each other;

b. in towards the card slot;

c. perpendicularly away from the base members;

d. perpendicularly towards the base members; and e. further in towards the card slot.

51. A connector for electrically connecting a circuit card to a circuit board through circuits on flexible film which have some circuits terminated to the board and at least one free side extending away from the board, comprising:

a. two base members for parallel mounting on a circuit board with a circuit card receiving slot there between.

b. a shroud assembly comprising two side members which may be fastened together with a circuit card in between and each having depending skirts with actuator support means thereon, said assembly being located so that each skirt is positioned on a base member and a card, if present, extends into the card receiving slot;

c. a pair of actuators, each being received on one of the actuator support means and capable of reciprocal travel parallel to the longitudinal axis of the card slot, said actuators each having a cam bar on which are repeating cam sets, each set having a number of spaced cams on each edge and each side of the bar; and d. a plurality of modules, each having a base wall joining side walls to define a channel open at both ends and on one side, and further having cam followers on the inside surface of each side wall and the base wall and over the channel side opening, and further, the outside surface of the base wall providing a surface for receiving a free side of a flexible film, said modules being located on the cam bars with the film receiving surfaces facing the card slot and with the cam followers cooperating with the cams so that upon moving the actuators longitudinally, the modules are moved laterally and normally relative to the base members.

52. The connector of claim 51 further including locating and locking means on and for locating the base members, shroud assembly and modules in pre-determined registration with each other and for removably locking the modules against longitudinal movement.

53. The connector of claim 52 wherein the locating and locking means include notches on the base members, recesses on the shroud assembly and L-shaped fingers on the modules, each of said L-shaped fingers being simultaneously receivable in a notch and recess when the base members, shroud assembly and modules are in a pre-determined registration one to the other.

54. The connector fo claim 53 wherein the actuator support means include slots in and extending along the length of the depending skirts and opening out towards the card slot and the actuators include a guide bar connected to the cam bar and slidably received in the slots.

55. The connector of claim 53 wherein the cams on the edges of the cam bar cooperate with the cam followers on the inside surfaces of the side walls of the modules to move the modules normally relative to the base members.

56. The connector of claim 55 wherein the cams on the side of the cam bar cooperate with the cam followers on the base wall and over the channel side opening of the modules to move the modules laterally relative to the base members.

57. The connector of claim 56 wherein the cam followers on the base wall of the modules include a convex surface adjacent the free end of a cantilever beam.

58. The connector of claim 57 wherein the cantilever beam is formed from and is part of a plate of resilient material, the plate being positioned against the base wall with the cantilever beam extending obliquely away therefrom.

59. The connector of claim 58 wherein the cantilever beam is compressed towards the base wall by a cam on the cam bar during longitudinal travel of the actuator.

60. The connector of claim 59 wherein the cantilever beam acts as a two stage spring during compression, the first stage occurring during resilient deformation from the static position to where the free end of the beam first contacts the plate or base wall and the second stage occurring during further resilient deformation thereafter.

61. The connector of claim 55 wherein the initial longitudinal movement of the actuators move the modules in a direction normal to and away from the base members and places the L-shaped fingers in aligned notches and recesses to locate the base members, shroud assembly and modules in a pre-determined registration one to the other and to lock the modules against longitudinal movement.

62. The connector of claim 61 wherein additional longitudinal movement of the actuators move the modules laterally towards the card slot so that circuits on the free side of the flexible films which may be received on the surface of the modules will lightly touch circuits on a card which may be in the slot.

63. The connector of claim 62 wherein additional longitudinal movement of the actuators move the modules normally and sequentially away from the base members and towards the base members whereupon the lightly touching circuits on the flexible film and on the card wipe and back-wipe each other.

64. The connector of claim 63 wherein additional longitudinal movement of the actuators move the modules laterally towards the card slot so that the circuits on the flexible film and on the card are more firmly pressed against each other.

65. A connector for electrically connecting the circuits on two circuit cards to circuits on a circuit board through circuits on a flexible film having some circuits thereon terminated to the board and two free sides extending away therefrom in opposite directions, comprising:

a. an elongated base member for mounting on a circuit board with circuit card receiving spaces along each side and having elongated base sections parallel to and adjacent each card receiving space;

b. support means on each base section for supporting actuator means;

c. two elongated actuator means, each having cams thereon and slidably mounted on the support means on the base sections for longitudinal travel;

d. two modules, each having one surface for receiving a free side of a flexible film which may extend there between and one or more cam followers, the modules being movably mounted so that the one surface faces towards a card receiving space and the one or more cam followers cooperate with the cams such that by moving the actuator means longitudinally, the modules move laterally towards and away from the card receiving spaces.

66. The connector of claim 65 wherein the modules include cam followers which cooperate with cams on the actuating means to drive the modules perpendicular relative to the axis of the base members during longitudinal travel of the actuating means.

67. The connector of claim 66 further including cooperating locating and locking means on and for positioning the base section, the support means and modules in a pre-determined registration and for locking the module against longitudinal travel.

68. The connector of claim 66 wherein the support means include a side member to which a circuit card may be attached and a skirt which rests on the base section such that the card extends into the card receiving space and each module and actuating means are between a card and a skirt.

69. The connector of claim 68 wherein each skirt includes a slot and the actuating means include a guide bar which is slidably received in and supported by the slot.

70. The connector of claim 69 wherein the cams on the actuating means are on the sides and edges of cam bars which are joined to the guide bars by connecting means so that the cam bars move longitudinally along a space between the skirts and card receiving spaces.

71. The connector of claim 70 wherein the modules are channel shaped having base and side walls and the cam bars move slidingly there through.

72. The connector of claim 71 wherein cam followers are provided on the base walls of the channel shaped modules to cooperate with cams on one side of the cam bars to move the modules laterally towards the card receiving spaces.

73. The connector of claim 72 wherein cam followers are provided over the mouth of the channel shaped modules to cooperate with cams on another side of the cam bars to move the modules laterally away from the card receiving spaces.

74. The connector of claim 73 wherein cam followers are provided on side walls of the channel-shaped modules to cooperate with cams on the edges of the cam bars to move the modules perpendicular relative to the longitudinal axis of the base member.

75. The connector of claim 68 further including locating means on the skirts and on the modules to locate the skirts and modules in a pre-determined registration one to the other.

76. The connector of claim 75 wherein the modules include base and side walls and the cam followers cooperating with said cams to move the modules laterally include convex surfaces near free ends of cantilever beams extending obliquely from said base wall.

77. The connector of claim 76 wherein the cantilever beams are formed from and attached to plates of resilient material and the plates are positioned against the base walls.

78. The connector of claim 77 wherein the cantilever beams are compressed towards the plates upon the modules being moved laterally towards and engaging card which may be in the card receiving spaces.

79. The connector of claim 78 wherein the force required to compress the cantilever beams increases upon the free ends thereof engaging the plate.

80. The connector of claim 74 wherein the cams and cam followers cooperate to move the modules in the following, time separated, sequential movements as the cam bars are drawn longitudinally in one direction;

a. laterally in towards the card receiving spaces so that the circuits on a free side of a flexible film which may be positioned on the one surface of each module will lightly touch circuits on circuit cards which may be in the card receiving spaces;
b. perpendicularly, away from the board, so that the lightly touching circuits wipe across each other;
c. perpendicularly, towards the board, so that the lightly touching circuits wipe back across each other; and
d. laterally further in towards the card receiving spaces so that the circuits press against each other more firmly.

81. The connector of claim 1 wherein the base member includes a pair of support means, each being adjacent a card receiving space on each side of the base member to provide a basis for two, side by side connectors with each connector adapted to connect a separate circuit card to the circuit board.

82. The connector of claim 27 wherein at least one base member includes two actuator guide means facing in diametric directions so that a third base member may be mounted on the circuit board parallel the one base member to define a second card slot and thereby provide the basis for two connectors, side by side, with each connector connecting two circuit cards to the circuit board.

83. The connector of claim 51 further including a third base member for parallel mounting on the circuit board adjacent one of the two base members and with a circuit card receiving slot therebetween so that a second shroud assembly, actuators and modules may be added to provide a second connector for connecting a second circuit card to the circuit board.

* * * * *

UNITED STATES PATENT OFFICE

CERTIFICATE OF CORRECTION

Patent No. 4,629,270 Dated December 16, 1986

Inventor(s) Clifford Frank Bobb, et al.

It is certified that error appears in the above-identified patent and that said Letters Patent are hereby corrected as shown below:

Column 10, line 31, after the word 'followers', insert ---on each side wall, two cantilever beam cam followers and two cam followers---.

Column 11, line 66, delete "materials" and insert ---material---.

Column 12, line 19, after the word 'include', insert ---a---.

Column 13, line 26, delete "fo" and insert ---of---.

Column 13, line 37, delete "side" and insert ---sides---.

Signed and Sealed this

Tenth Day of March, 1987

*Attest:*

DONALD J. QUIGG

*Attesting Officer*

*Commissioner of Patents and Trademarks*

Notice of Adverse Decisions in Inteference

In Interference No. 102,039, involving Patent No. 4,629,270, H. W. Andrews, Jr., C. F. Bobb, R. F. Cobaugh, (deceased), J. R. Cobaugh, executrix; and A. S. Taylor, ZERO INSERTION FORCE CARD EDGE CONNECTOR WITH FLEXIBLE FILM CIRCUITRY, final judgment adverse to the patentees was rendered November 24, 1989, as to claims 1-10, 27-35, 65-69, 81 and 82.

*(Official Gazette February 20, 1990)*